United States Patent [19]

Miyama et al.

[11] Patent Number: 4,846,127

[45] Date of Patent: Jul. 11, 1989

[54] FUEL SUPPLY CONTROL SYSTEM FOR AN AUTOMOTIVE ENGINE

[75] Inventors: Syuuji Miyama, Hohya; Hiroya Ohkumo, Koganei, both of Japan

[73] Assignee: Fuji Jukogyo Kabushiki Kaisha, Tokyo, Japan

[21] Appl. No.: 216,900

[22] Filed: Jul. 8, 1988

[30] Foreign Application Priority Data

Jul. 28, 1987 [JP] Japan ..... 62-189678

[51] Int. Cl.[4] ..... F02D 41/12

[52] U.S. Cl. ..... 123/325; 123/333

[58] Field of Search ..... 123/325, 326, 493, 333, 123/332, 198 DB

[56] References Cited

U.S. PATENT DOCUMENTS 4,414,941 11/1983 Nakanishi ..... 123/325

4,638,781 1/1987 Shiki et al. ..... 123/333

FOREIGN PATENT DOCUMENTS 54-20230 2/1979 Japan .

58-170830 10/1983 Japan ..... 123/493

58-195030 11/1983 Japan .

*Primary Examiner*—Andrew M. Dolinar

*Attorney, Agent, or Firm*—Martin A. Farber

[57] ABSTRACT

An idle switch is provided to respond to release of an accelerator pedal of a motor vehicle, for producing an idle signal. A large increment of the engine speed after the production of the idle signal is detected and an engine speed increase signal is produced. The increment is compared with a predetermined value and an immediate cutoff signal is produced when the increment is larger than the predetermined value. In response to the immediate cutoff signal fuel supply is immediately cut.

3 Claims, 4 Drawing Sheets

FUEL SUPPLY CONTROL SYSTEM FOR AN AUTOMOTIVE ENGINE

BACKGROUND OF THE INVENTION

The present invention relates to a fuel cutoff control system for an engine of motor vehicles, and more particularly to a system for preventing the increase of engine speed when an accelerator pedal is released and a clutch is disengaged.

In an electronic fuel injection system, the amount of fuel supplied to an engine is calculated based on amount of air inducting into an intake passage, speed of engine, and others. The injection of the fuel is temporarily cut off during coasting when the accelerator pedal is released and the engine speed is high so as to improve the engine braking effect, emission control and fuel consumption. Numerous means for cutting off the fuel and timing thereof in various driving conditions have been proposed.

For example, Japanese Patent Laid Open No. 54-20230 discloses a system wherein the supply of fuel is stopped after a predetermined time from the time when the conditions for the cutoff are fulfilled. Therefore, fluctuation of torque is restrained to decrease a shock.

On the other hand, when a clutch is disengaged for shifting gears in a transmission after the accelerator pedal is released, the amount of air inducting into the intake passage is reduced. However, fuel adhered on walls of the intake passage is vaporized, resulting in enrichment of the air-fuel mixture. On the other hand, since the amount of fuel injection becomes extremely small at gear shifting in the electronic fuel injection system, the operation of the injector becomes inaccurate so that the air-fuel mixture becomes over lean.

In order to prevent the combustion from damping which occurs as a result of such an irregular concentration of the air-fuel mixture, Japanese Patent Laid Open No. 58-195030 proposes to cut the fuel when the amount of change of the inducting into the intake passage air per one revolution of a crankshaft of an engine is under a predetermined amount during the disengagement of the clutch.

However, in an engine having a large intake manifold volume downstream of a throttle valve, the amount of air inducting into a combustion chamber does not immediately reduce after the release of the accelerator pedal. Particularly, in an electronic fuel injection system wherein the amount of fuel is determined depending on pressure of the intake passage, the reduction of supplied fuel is retarded, corresponding to the delay in reduction of the air inducting into the combustion chamber, thereby delaying in decreasing the engine torque. Accordingly, if the clutch is disengaged immediately after the throttle valve is rapidly closed, the engine speed quickly and largely increases due to the non-load condition.

Although the fuel supply is stopped for coasting at high engine speed, neither of the above-mentioned prior arts prevents the speed up of the engine.

SUMMARY OF THE INVENTION

The object of the present invention is to provide a fuel cutoff control system wherein the increase of engine speed, which occurs when a clutch is disengaged, may be prevented.

According to the present invention, there is provided a fuel supply control system for an engine of a motor vehicle having fuel supply means, and an accelerator pedal, the system comprising an idle switch responsive to the release of the accelerator pedal for producing an idle signal, sensing means for sensing speed of the engine and for producing an engine speed signal, detector means for detecting rapid increase of the engine speed after the production of the idle signal and for producing an engine speed increase signal, the value of which is dependent on magnitude of the increase, deciding means for comparing the value of the engine speed increase signal with a predetermined value and for producing a delayed cutoff signal when the value is smaller than the predetermined value and for producing an immediate cutoff signal when the value is larger than the predetermined value, fuel cutoff means responsive to the delayed cutoff signal for stopping the operation of the fuel supply means after a predetermined time and responsive to the immediate cutoff signal for stopping the operation of the fuel supply means so as to immediately cut off the fuel supply.

In an aspect of the present invention, the detector means is a calculator for calculating an increment of engine speed.

The other objects and features of this invention will become understood from the following description with reference to the accompanying drawings.

DETAILED DESCRIPTION OF THE PREFERRED EMBODIMENT

Figure 1:
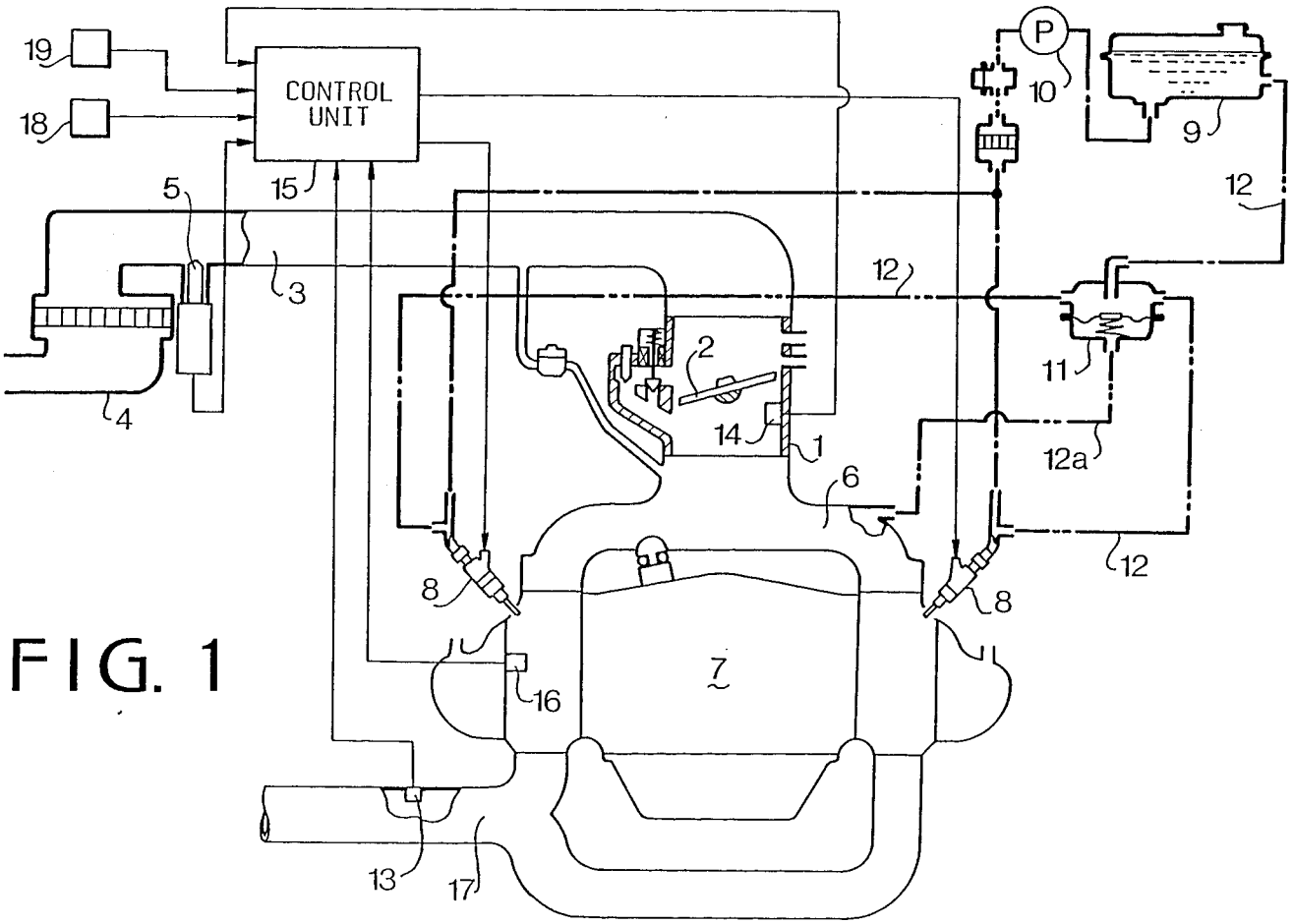
FIG. 1 is a schematic diagram showing a system of the present invention.

Referring to FIG. 1, an engine 7 has a throttle body 1 having a throttle valve 2 communicated with an intake pipe 3. In the intake system, an air cleaner 4 and intake air temperature sensor 5 are provided. The throttle body 1 is further communicated with an intake manifold 6 which is communicated with a combustion chamber of each cylinder (not shown) in the engine 7. In an exhaust pipe 17, an $O_2$-sensor 13 is provided. Fuel is supplied to fuel injectors 8 from a fuel tank 9 by a fuel pump 10, and returned to the tank 9 through a passage 12 and a pressure regulator 11 which is opened by intake manifold pressure applied through a pipe 12*a*. An intake manifold pressure sensor 14 is provided in the throttle body 1 for detecting intake manifold pressure P. A coolant temperature sensor 16 is provided in the engine 7 for detecting of temperature of the coolant. The coolant temperature sensor 16 produces an output signal, the voltage of which is dependent on the temperature. Output signals of the sensors 5, 13, 14 and 16 are applied to a control unit 15 for controlling fuel injectors 8. The control unit 15 is further applied with a pulse signal from crank angle sensor (engine speed sensor) 18 representing engine speed N and with a signal from an idle switch 19 which is turned on when an accelerator pedal of the vehicle is released.

Figure 2:
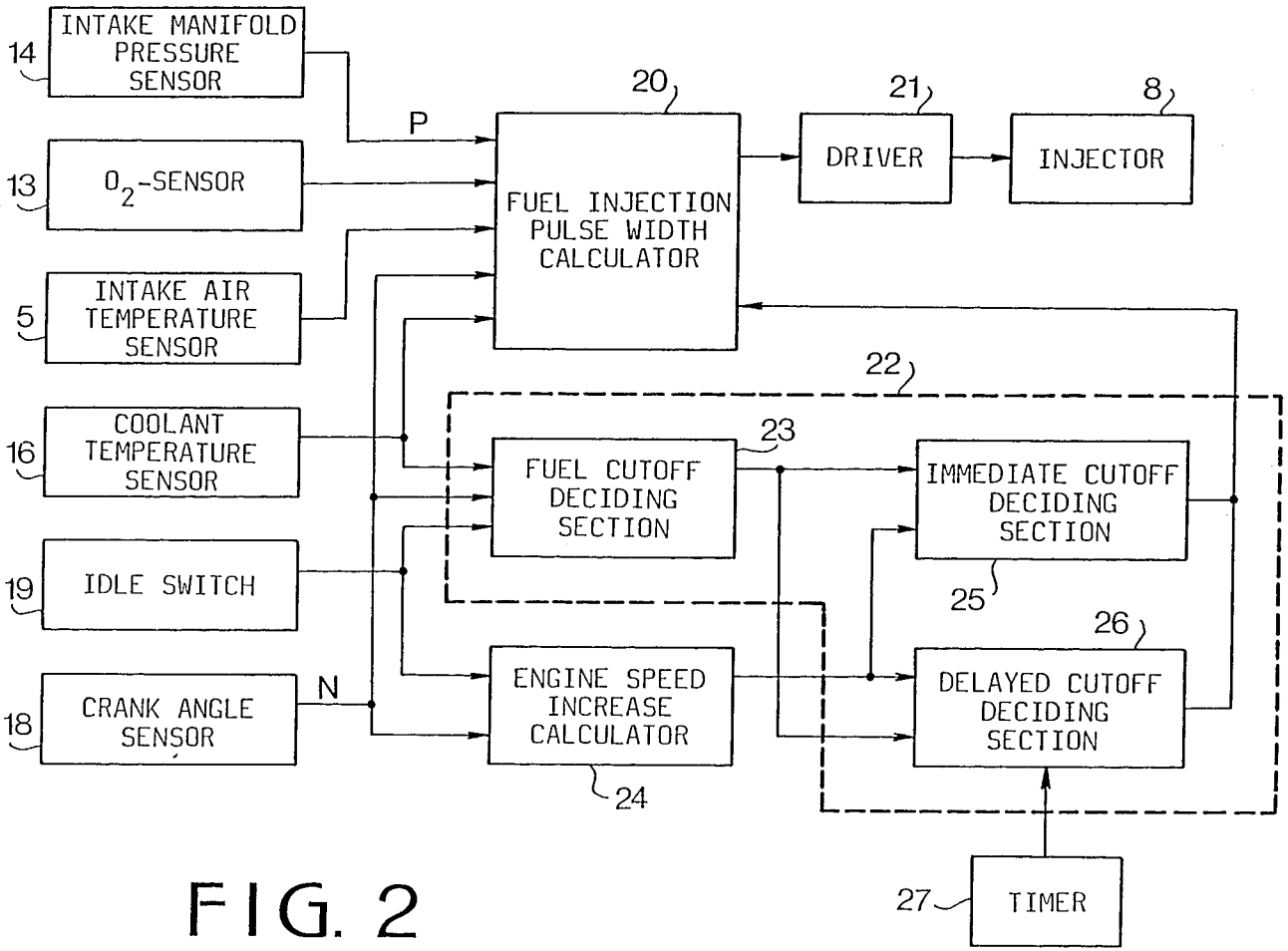
FIG. 2 is a block diagram of a control system of the present invention.

Referring to FIG. 2 showing the control unit 15, a fuel injection pulse width calculator 20 is applied with output signals of the intake air temperature sensor 5, intake manifold pressure sensor 14, coolant temperature sensor 16, $O_2$-sensor 13 and crank angle sensor 18. The fuel injection pulse width calculator 20 calculates a basic pulse width dependent on the intake manifold pressure P and the engine speed N from sensors 14 and 18, respectively. The basic pulse width is corrected in accordance with output signals of the coolant temperature sensor 16 intake air temperature sensor 5 and $O_l$ 2-sensor 13 to obtain an appropriate fuel injection pulse width in the engine operating condition. A fuel injection pulse width signal from the fuel injection pulse width calculaor 20 is applied to fuel injectors 8 through a driver 21 to inject the fuel to operate the engine.

In order to cut off the fuel at idling of the engine, a fuel cutoff control section 22 is provided in the control unit 15. The fuel cutoff control section 22 has a fuel cutoff deciding section 23 to which output signals of the coolant temperature sensor 16, crank angle sensor 18 and idle switch 19 are applied. The fuel cutoff deciding section 23 determines that the vehicle is under a fuel cutoff condition when an engine speed N exceeds a predetermined cutoff engine speed $N_C(N \geqq N_C)$ while the accelerator pedal is released in the engine warmed-up state. The engine speed N and the output signal of the idle switch 19 are also supplied to an engine speed increase calculator 24 where increment $\Delta N$ or increasing rate of the engine speed is obtained by either of the following equations.

$$\Delta N = N_E - N_{iD},$$

$$dN_E/dt \text{ or } dN_E/d\theta$$

where $N_E$ is the engine speed after a predetermined time from closing of idle switch 19, $N_{iD}$ is the engine speed when the idle switch is turned on, t is the elapsed time and $\theta$ is the crank angle.

The output signals of the deciding section 23 and the calculator 24 are fed both to an immediate cutoff deciding section 25 and a delayed cutoff deciding section 26 to which a set delay time signal is applied from a timer 27. An output signal from the cutoff deciding sections 25 or 26 is applied to the injection pulse width calculator 20 in order to compulsively cutoff the fuel injection.

The operation of the system will be described hereinafter with reference to a flowchart shown in FIG. 3 and to graphs shown in FIGS. 4*a* to 4*d*.

Figure 3:
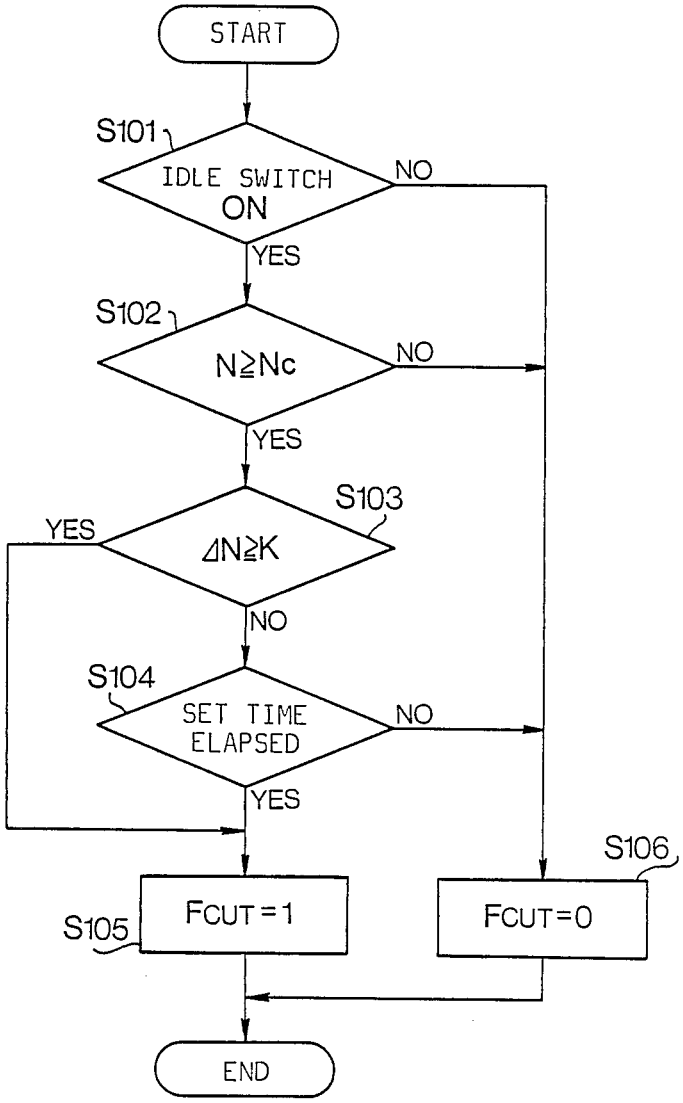
FIG. 3 is a flow chart showing the operation of the control system.

Referring to FIG. 3, at a step S101, it is determined whether the idle switch is on or off. When the accelerator pedal is depressed for the acceleration of the vehicle, the idle switch 19 is off so that the program proceeds to a step S106. Thus, the fuel cutoff deciding section 23 determines that the engine is not under a condition for the fuel cutoff so that a fuel signal is applied to the fuel injection pulse width calculator 20. Accordingly, the injection pulse width obtained in dependence on the intake manifold pressure P and engine speed N and others is fed to the injector 8 so as to provide an appropriate air-fuel ratio in relation to the amount of intake air, in any engine operating conditions.

When the accelerator pedal is released while the vehicle is driven or at a stop, idle switch is turned on. Therefore, the program proceeds to a step S102 where it is determined whether engine speed N is larger than the predetermined cutoff speed $N_C$. When the engine speed N is smaller than the speed $N_C(N < N_C)$, the program goes to the step S106, so that fuel injection is continued.

Figure 4A:
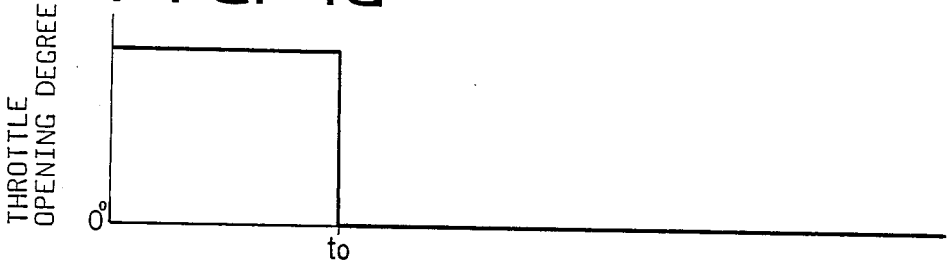
FIGS. 4*a* to 4*d* are graphs showing variations of throttle opening degree, engine torque, engine speed and fuel injection at delayed cutoff and at immediate cutoff, respectively.
Figure 4B:
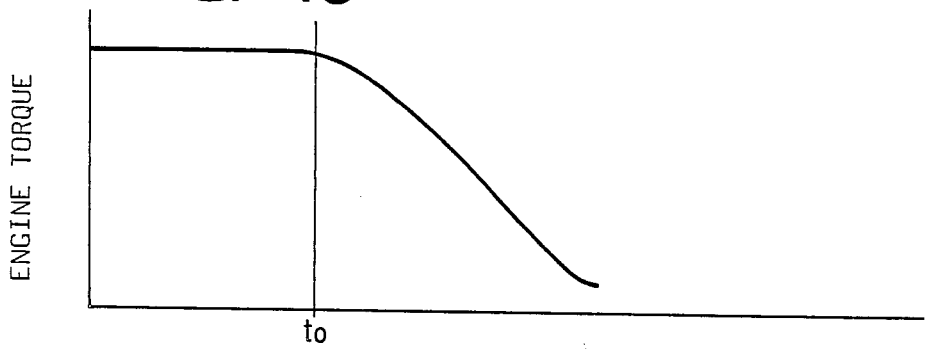
Figure 4C:
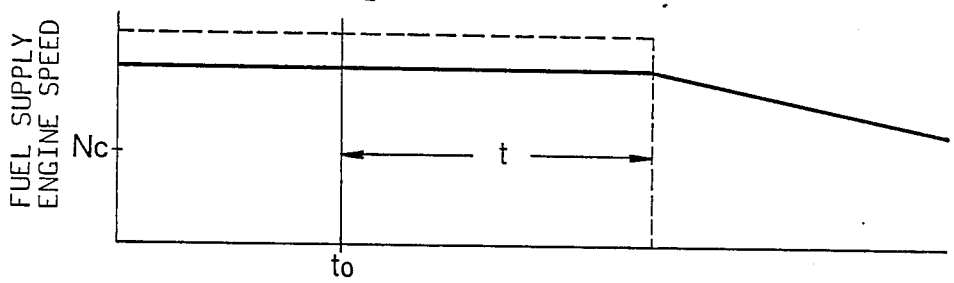

When the acceleration pedal is suddenly released to close the throttle valve at a time $t_O$ (FIG. 4*a*), while the engine speed N is larger than the fuel cutoff speed $N_C$ $(N \geqq N_C)$ FIG. 4*c*), the fuel cutoff deciding section 23 determines that the vehicle is under the fuel cutoff condition, thereby applying a signal to the immediate cutoff deciding section 25 and delayed cutoff deciding section 26. In the electronic fuel injection system for an engine having a large intake manifold volume, engine torque gradually decreases as shown in FIG. 4*b*.

At a step S103, the engine speed increment $\Delta N$ is calculated at the engine speed increase calculator 24 and the increment $\Delta N$ is compared with a predetermined reference value K. The output of the calculator 24 is applied to the deciding sections 25 and 26. When the clutch is engaged during the release of the accelerator pedal, the load of a transmission system exerted on the engine restrains the increase of the engine speed as shown in FIG. 4*c*. When the increment $\Delta N$ is smaller than the reference value K $(\Delta N < K)$, counting of the delay time set in the timer 27 is started. When the set time has elapsed, the program proceeds to a step 105 where a fuel cut flag FCUT is set. Therefore, a cutoff signal from the delayed cutoff deciding section 26 is applied to the fuel injection pulse width calculator 20 to stop the injection as shown by a dotted line in FIG. 4*c*.

Figure 4D:
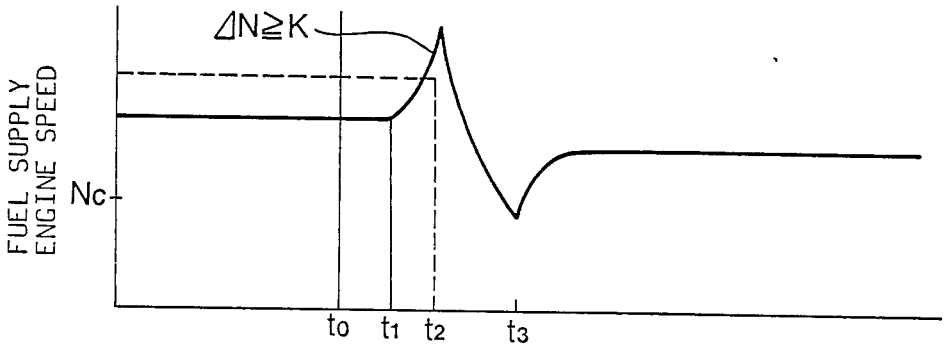

If the clutch is disengaged at a time $t_1$ immediately after the release of the accelerator pedal in order to shift the change speed gear, the remaining torque of the engine speeds up the engine as shown in FIG. 4*d*. When the engine speed increment $\Delta N$ becomes larger than the predetermined value K, the program proceeds directly to the step S105. Accordingly, the fuel is cutoff at a time $t_2$ as shown by a dotted line in FIG. 4*d*. Thus, the engine speed decreases until the gear shift operation is completed at a time $t_3$. When the accelerator pedal is depressed, the idle switch 19 is turned off, thereby injecting the fuel (steps S101, S106). Thus, the engine speed increases in accordance with the depression of the accelerator pedal.

During the cutoff of the fuel while coasting, if the engine speed N becomes lower than the predetermined cutoff speed $N_C$, the fuel injection is restored by the signal from the fuel cutoff deciding section 23 (steps S102, S106).

The system of the present invention may also be applied to an engine provided with a carburetor.

In accordance with the present invention, when the clutch is disengaged in order to shift gears of the manual transmission, the speed up of the engine is prevented without fail.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A fuel supply control system for an engine of a motor vehicle having fuel supply means, and an accelerator pedal, the system comprising:

an idle switch responsive to the release of the accelerator pedal for producing an idle signal;

sensing means for sensing the speed of the engine and for producing an engine speed signal;

detector means for detecting rapid increase of the engine speed dependent of on the engine speed signal after the production of the idle signal and for producing an engine speed increase signal the value of which is dependent on magnitude of the increase;

deciding means for comparing the value of the engine speed increase signal with a predetermined value and for producing a delayed cutoff signal when the value is smaller than the predetermined value and for producing an immediate cutoff signal when the value is larger than the predetermined value;

fuel cutoff means responsive to the delayed cutoff signal for stopping the operation of the fuel supply means after a predetermined time and responsive to the immediate cutoff signal for stopping the operation of the fuel supply means so as to immediately cut off the fuel supply.

2. The system according to claim 1 wherein the detector means is a calculator for calculating an increment rate of engine speed.

3. The system according to claim 1 wherein the detector means is a calculator for calculating an increasing rate of engine speed.

* * * * *